United States Patent [19]

Rickert

[11] 3,938,348

[45] Feb. 17, 1976

[54] VENTILATING AND/OR COOLING DEHUMIDIFIER

[76] Inventor: Glenn E. Rickert, Community State Bank Bldg., Huntington, Ind. 46750

[22] Filed: Oct. 15, 1974

[21] Appl. No.: 514,501

[52] U.S. Cl. ..... 62/97; 62/262; 62/122; 62/427; 62/176; 62/180

[51] Int. Cl.[2] ..... F25D 17/06

[58] Field of Search ..... 62/262, 122, 427, 176, 62/97, 180

[56] References Cited

UNITED STATES PATENTS

| | | | |
|---|---|---|---|
| 2,236,191 | 3/1941 | Wolfert | 62/180 |
| 2,296,530 | 9/1942 | McGrath | 62/176 |
| 2,321,242 | 6/1943 | Ramsey | 62/97 |
| 2,549,547 | 4/1951 | Trask | 62/262 |
| 2,711,087 | 6/1955 | Jennings | 62/180 |
| 2,769,320 | 11/1956 | Kuhlenschmidt | 62/427 |
| 2,811,022 | 10/1957 | Lathrop | 62/262 |
| 2,939,296 | 6/1960 | Coblentz | 62/97 |
| 3,015,216 | 1/1962 | Coblentz | 62/180 |
| 3,373,577 | 3/1968 | Bohman | 62/180 |
| 3,517,523 | 6/1970 | Brown | 62/180 |

*Primary Examiner*—William J. Wye
*Attorney, Agent, or Firm*—Albert L. Jeffers; Roger M. Rickert

[57] ABSTRACT

A simple climate control device is disclosed which can independently, or jointly, to the degree desired, ventilate and/or dehumidify and/or cool a dwelling. The device provides a way of supplying fresh outside air to a building or other space at a preferred humidity level while optionally cooling the inside air, and as desired dehumidifying the inside air to maintain the inside environment at a preferred temperature and at a preferred relative humidity, with gradual displacement of stale air by fresh air.

11 Claims, 3 Drawing Figures

VENTILATING AND/OR COOLING DEHUMIDIFIER

BACKGROUND OF THE INVENTION

This invention relates to refrigeration air conditioners and to dehumidifiers.

Conventional home air conditioners regardless of their type, generally have a constantly blowing room air fan, circulating air from the room, through the evaporator coil, and back into the room. The temperature of the room being controlled by turning the compressor on and off, to occasionally cool the evaporator coil below the room air temperature, sufficiently and frequently enough to cool the room air to the desired temperature.

Due to their design, however, it can be seen that such air conditioners are totally incapable of dehumidifying inside room air unless they are in the cooling portion of the cycle, and incapable of dehumidifying any outside fresh air they bring in unless they are in the cooling portion of the cycle. Conventional home air conditioners are therefore especially useless on a day when the outside temperature is say 67°F and it is raining with a 100% relative humidity at that 67°F. The air conditioner cannot dehumidify the room air or ventilate the dwelling with dehumidified air because it is not in a cooling cycle, so the dwelling becomes humid, and uncomfortable for occupancy even though the dwelling is not actually too warm.

Large complicated and expensive systems have been designed to adequately cool, ventilate, and dehumidify, but their cost is prohibitive to most homeowners.

It is one object of this invention to provide a simple and inexpensive fresh air ventilating system for a dwelling to be used in both the cold wintertime and in the hot humid summertime where excessive relative humidity of that fresh air can be optionally reduced without cooling the dwelling.

It is another object of this invention to provide a cooling system which can cool an otherwise hot and humid dwelling and which also has means to optionally choose the relative humidity that such cooling will provide.

It is a further object of this invention to provide a simple and economical system to manufacture which can jointly or independently, to the degree desired, ventilate and/or dehumidify and/or cool a dwelling.

It is a salient object of this invention to provide a device which without cooling the dwelling more than desired, can make a dwelling comfortable to occupy, by reducing the relative humidity of the dwelling to a sufficiently low level as to permit being comforatable in the dwelling when it has a higher temperature than would otherwise be desirable thus providing a healthier environment while serving electricity.

SUMMARY OF THE INVENTION

The foregoing objects as well as numerous other objects, features and advantages of the present invention are achieved by providing a method and apparatus for bringing in or injecting a limited quantity of outside fresh air, passing the fresh air over an evaporator cooling coil to cool the injected air to a preset dew point temperature to condense any excess moisture from the air, and passing the demoisturized air into an area, space, or building or part thereof so that the incoming fresh air has no more than the preferred moisture content or relative humidity. The cooling of the area to a selected temperature is achieved by controlling the volume of room air that is recirculated past the same cooling coil shared by the fresh incoming air, so that the room air which is recirculated also has any excess moisture condensed therefrom to maintain the inside environment of the space or room at no more than a preferred humidity as well as at a preferred temperature. In an exemplary embodiment, an evaporator cooling coil of a refrigeration system is maintained at a temperature through a coil temperature sensing control device, sufficiently low to condense the undesired moisture from any air that passes through the coil, and a room or space air temperature sensing device selectively controls if, when, and how much volume of inside air is forced past the cooling coil to cool the room area, or space as desired.

Other objects, features, and advantages of the invention will appear or be pointed out in the following description.

DESCRIPTION OF THE PREFERRED EMBODIMENT

Figure 1:
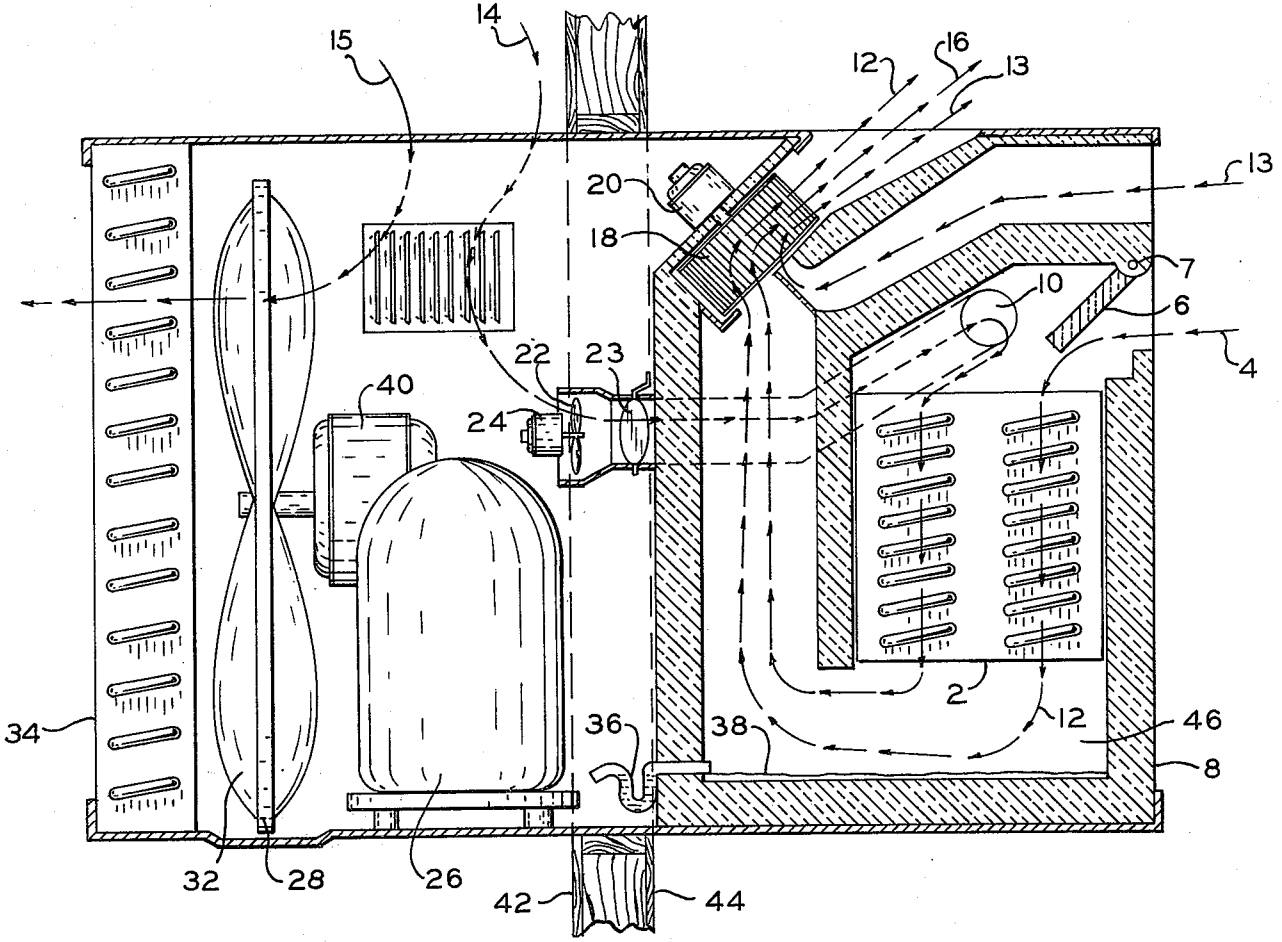
FIG. 1 is a diagramatic representation of the invention showing the various mechanical parts located so as to illustrate their function.

Although the invention applies to any type of air conditioner as well as to the separate functions of this climate control, a window installation type of unit is shown having the combined functions of the invention in one unit to more simply illustrate how the invention differs from conventional dehumidifiers and air conditioners.

The climate control unit invention in the drawing functions in a very contrary fashion to conventional self contained, central, or window air conditioners. For example, conventional air conditioners constantly circulate room air through the evaporator coil and the temperature of the room is controlled by cycling the refrigeration system on and off to give the amount of cold required for a given situation of room heat input. When the coil has cooled the room sufficiently the coil is allowed to be warmed up to room temperature by the room air constantly circulating through the coil and, undesirably whatever moisture is on the coil, evaporates back into the room as room humidity.

The invention, on the contrary, in its preferred form, provides a temperature and air protected evaporator coil which is constantly maintained at or below a desired dew point temperature, and the temperature in the dwelling space is controlled by cycling the room air blower to blow the needed volume of room air through the cold evaporator coil and back into the room to get the amount of cold required for a given situation of room heat, after which room air ceases to be blown through the evaporator coil thus ending the cooling effect and thus preventing any condensed moisture on the coil from evaporating back into the room air.

Looking now at FIG. 1, the unit sets partly inside 44 of the house and partly outside 42 of the house as illustrated by the representative house wall 42, 44. It could set all inside or all outside with appropriate duct work to channel the hot or cold air where desired. In a self contained or central air conditioner, proper evaporation coil location with the proper pipes to the condenser coil would be employed, or proper ductwork, would be employed.

On the inside side 44 of the house wall is the refrigeration evaporator coil 2. This evaporation coil 2 in the preferred form is maintained at a selected cool or dew point temperature all the time the unit is in operation, regardless of whether it is cooling the room at the time or not. Therefore to aid maintaining the evaporator coil at constantly cold temperatures, the coil is temperature protected by an insulated enclosure 8. A swinging door 6 is pivoted at 7 to protect it from undesired air flow and remains normally closed. It can be weight counterbalanced or spring assisted. It opens only when the room air thermostat requests the room be cooled which the thermostat then turns on the fan motor 20 that revolves the fan 18 which suction pulls the door 6 open to pump room air 4 through the cold evaporator 2 and blow it out into the room as cold air 12. An extra volume of uncooled room air 13 is mixed with the cold air 12 to alleviate its extreme cold before it is blown out through the room.

A second but smaller volume fan 22 driven by a small fan motor 24 pumps a certain preselected volume of outside fresh air 14 in from the outside of the dwelling.

A fresh air volume limiter shown as a butterfly valve 23, or other conventional system, is used to control the desired volume of fresh outside air 14 brought in from the outside through opening 10, which small volume of fresh air passes through the cold evaporator coil 2, passes up through the operating or non-operating fan 18 and out into the room as dehumidified fresh air 16. This air 16 can also be mixed with uncooled room air 13. A stale air outlet elsewhere in the dwelling or space allows the exit of the used air. This is accomplished by the normal cracks and crevices in the building, by operating an exhaust fan, by a slightly opened window, or by some other suitable air exit.

In the cooling cycle when fan 18 pumps a large volume of room air 4 through the evaporator coil 2, to cool the room with chilled air 12 and also in the fresh cycle when only the fresh air fan 22 pumps a much smaller volume of outside fresh air 14 in through opening 10 and evaporator 2 and out into the room as dehumidified fresh air 16, the evaporator coil 2 is held by the refrigeration system to some selected cold temperature range employing the dew point principle to provide the relative humidity desired in the dwelling. The water condensed from the air falls from the condenser 2 and collects as water 38 in the bottom of the cold chamber 46. The condensed water passes through a water trap 36, to prevent cold air leakage at this point, and drains out into the base of the unit and is slung and blown through the condenser coil 34 by the fan slinger 28 and fan 32, which is revolved by fan motor 40, or simply drains out of the bottom of the unit.

The conventional connecting refrigeration pipes are not shown to avoid confusion, and the compressor 26 in the drawing is illustrated as a sealed unit type, but it could be any suitable type. This compressor 26 pumps the refrigerant around through the evaporator 2 and condenser 34 coils so that the various parts act as a refrigerating system to cool the evaporator coil 2 surfaces and cold chamber 46.

Figure 2:
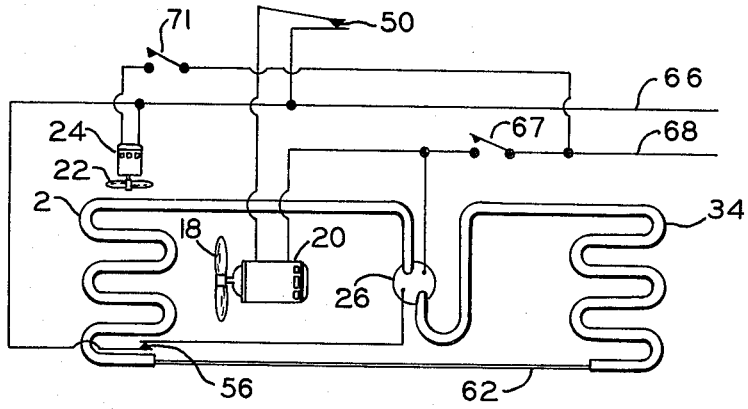
FIG. 2, is a simplified schematic representation of one form of the invention.

The sensing controls and the electrical system is shown in the preferred form in FIG. 2 where line voltage is supplied by lines 66, 68, connected to the various parts of the unit. The compressor 26 is turned on and off to constantly maintain the evaporator coil 2 at a selected cold temperature range by an evaporator coil temperature sensor 56 or by an evaporator coil 2 pressure sensor or by any other suitable method, to control the coil 2 temperature. A room air temperature sensing thermostat 50 or other conventional room air temperature sensing device when necessary, calls for cold and turns on the room air circulating fan 18 motor 20. In the preferred form it does not directly control the compressor 26 of the refrigerating system to cool the room as is conventionally done.

The selected evaporator coil 2 temperature is chosen in relation to the relative humidity desired in the dwelling. The temperature in the room is controlled by the amount of room air 4, FIG. 1, blown through the cold evaporator coil 2, FIG. 2. A colder evaporator coil 2 condenses more humidity out of moist air giving a lower relative humidity at room temperature than does a warmer evaporator coil 2 temperature. If a properly designed evaporator coil is held at 35°F and the fresh air fan 22 of FIG. 1 brings in fresh humid outside air 14 to pass through the evaporator coil 2, it will enter the room as fresh air 16 having a relative humidity of less than 25% after the fresh air temperature has been raised in the room to 75°F.

with a properly designed evaporator coil these same relative humidities are provided during the cooling cycle. Such humidity control during cooling is often needed under conditions where a large amount of humidity and heat is generated within the dwelling itself.

The evaporator coil 2 FIG. 2 and condenser coil 34 are connected by the compressor 26 pipes on one side of the coils and by a capillary tube 62, or some other type of expansion valve control on the second side of the coils.

Thus in the preferred form of the invention we see in FIG. 2 that the evaporator coil 2 temperature sensor 56 closes contacts to start the compressor 26 whenever the evaporator coil 2 gets warmer than desired and opens whenever it gets colder than desired. The room air thermostat or temperature sensor 50 contacts close when the room gets too warm and the blower motor 20, fan 18 recirculates the warm room air past door 6 (FIG. 1) and through the coil 2 and back into the room to cool the room air. When the room air gets cold enough the room air temperature sensor 50 contacts open and the blower fan 18 stops blowing and the swinging door 6 closes.

Looking now at FIG. 2 the power supply lead lines 66, 68 have line switches 67, 71. The fresh air fan 22, motor 24 is energized by closing switch 71, and fresh air is pumped in from the outside. If dehumidification of that air is desired as in the humid summertime, switch 67 is also closed to activate the refrigeration system to cause the compressor to maintain the evaporator coil at the desired dew point temperature range by the coil temperature sensor switch or control 56. The condenser coil 34 can be cooled by a fan in a conventional manner. No fan is shown to avoid confusion.

Figure 3:
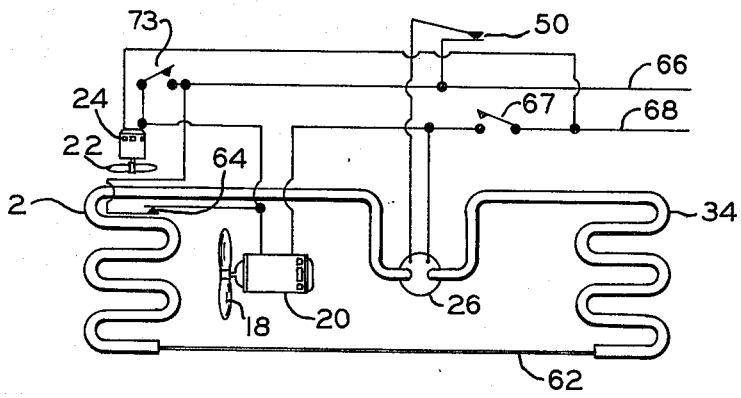
FIG. 3 is a simplified schematic representation of a modified form of the invention.

FIG. 3 shows a modified sensing and electrical system which does essentially the same thing that the system does in FIG. 2. That is, both systems limit the room air from being blown through the coil 2 until the compressor 26 has cooled the coil 2 to the desired dew point temperature chosen to give the desired relative humidity to the cooled room air. Here in FIG. 3 the room air temperature sensor 50 contacts close when the room air needs to be cooled and the compressor 26 motor starts and refrigerant is liquified to cool the evaporator coil 2. When the evaporator coil 2 becomes sufficiently cold to be at the desired dew point temperature, the coil temperature sensor 64 contacts close and the blower motor 20 is turned on and drives the blower fan 18 which blows room air through the cold coil 2 until the room is sufficiently cool. At this time the room air temperature sensor 50 contacts open the compressor stops, and the coil 2 begins to warm up from the room air being blow through it. When the evaporator coil 2 is warmed up to the chosen dew point temperature, the coil temperature sensor 64 contacts open and the fan 18 stops blowing room air through coil 2.

In FIG. 3 where electrical power supply lines 66, 68 are shown it should be noted that the fresh air fan 22 operated by its motor 24 is shown connected to the same electrical leads that operate the recirculation fan motor 20. The on and off temperature sensor control 64 of the recirculation fan motor 20 also turns the fresh air fan motor 24 on and off at the same time, namely when and only when the coil has been cooled to the desired dew point to control the humidity of the incoming fresh air. Here again as in FIG. 2, no condenser coil 34 fan is shown, but can optionally be employed in a conventional manner.

A separate electrical power lead to operate the fresh air motor 24 and fan 22 of FIG. 3 is shown whereby, when switch 67 is opened to turn off the refrigeration capability of the climate control unit, the fresh air fan 22 can be operated by closing switch 73 to blow fresh air into the dwelling if desired when neither cooling nor dehumidification is wanted, as for example, in dry and/or cold weather. As in the preferred form the temperature sensor 64 FIG. 3 can be replaced by other coil temperature controls.

Switches 73, 67 of FIG. 3 can be mechanically connected to permit the closure of only one switch at a time.

A word of explanation may be necessary concerning the stated non-cooling effect during the time chilled and dehumidified fresh air is being supplied to the dwelling. It is generally agreed that as little as 7½ cubic feet per minute of fresh air may be sufficient for each occupant of a dwelling, where smoking is not present.

It is interesting to note that as little as 25 cubic feet per minute of fresh air will change the air in a average sized residence 2 times to 3 times in 24 hours dependent of course on house size, but it is surprising to discover that to re-heat 25 cubic feet per minute of 30°F saturated air, to 80°F air, requires less electrical heat than the electricity consumed by an average sized household light bulb. Therefore, such a small cold input of 25 cubic feet per minute of 30°F air blown into a residence can for all practical purposes be considered only as dehumidified fresh air, while ignoring the very very small cooling effect. This small amount of dehumidified fresh air does however effectively ventilate and dehumidify.

As this invention comprises a dehumidified fresh air capability a dehumidifying cooling capability, and a capability which is the combination of both capabilities it is understood that each of these capabilities alone as described and claimed are part of this invention.

The compressor 26 may be divided into two compressors where one is used in the fresh air cycle and the other or both compressors are used in the cooling cycle. Additionally, a compressor may be used having a two speed motor to drive the compression pump portion at two different speeds to achieve two levels of evaporator coil capacity, and this two speed effect can be achieved by changing the number of poles activated in the compressor motor, as well as any other suitable motor speed control.

Other advantageous conventional controls can be applied to this invention to enchance its capability. For example, the volume of fresh air which flows into the evaporator coil can be limited during the cooling cycle to avoid excessive fresh air flow due to the operation of the large volume cooling fan 18 by restricting the air flow through opening 10 by a closure vane activated by the swinging door 6 or by any other suitable means. Also, the fresh air flow limiter 23 may be adapted to be negated or bypassed to let in a larger volume of fresh air when desired, as for example when a bathroom or kitchen range exhaust vent fan is being operated.

In the preferred form of the invention a coil temperature sensor turns the compressor on and off to hold the evaporator coil at a selected dew point temperature range all the time the unit is employed regardless of whether the unit is cooling the room at the time or not. Also, in the preferred form of the invention, outside fresh air is pumped through this cold evaporator coil to condense any excess moisture from the fresh air, both when the cooling cycle is in operation as well as when the cooling cycle is not in operation.

If for any reason, however, the evaporator coil should be allowed to warm up above that desired dew point temperature range during part or even all of the cooling cycle, or during part of the fresh air ventilating action, does not depart from the scope of this invention as long as the temperature of the evaporator coil is low enough in temperature sufficiently long enough in time during the total period that outside fresh air, and/or recirculated room air is passed over the evaporator coil such as to provide the desired control over the humidity of the space or dwelling without excessively cooling the dwelling.

In addition to turn off the flow of outside fresh air during the cooling cycle, or, to permit outside fresh air to flow into the unit and on into the room only during the cooling cycle, does not depart from the intent and spirit of this invention. The fan 18 can run continuously, or a second room air fan can be employed, to continuously circulate room air in and out of the climate control unit or just blow air around in the room to more evenly mix the space air provided it does not circulate this air through the evaporator coil except when cooling is desired. Appropriate deflectors, gates and/or ductworks, or other suitable means, can be employed to direct this room air so it bypasses the air pathway through the evporator coil to achieve this desired mixing result.

The room air recirculating fan 18 for example can also by employed to bring in fresh outside air concurrently or alternately to recirculating room air to cool the room if proper air flow pathway controls are employed, thus eliminating the fresh air or outside air ventilating fan. The swinging door 6 could for example be weighted, spring loaded, or otherwise controlled to not open when a slower fresh air fan 18 speed is in effect and to only open when a higher speed room air cooling action was initiated by fan 18.

The room air recirculating fan 18 could for example be employed to bring in fresh air only when the unit is in its cooling cycle, with a switching arrangement to bring in outside air alone when cooling is not desired or needed, as in the winter.

A liquified refrigerant, or collector, tank can be employed with an expansion vlave in place of the capillary tube 62, FIG. 2. Other conventional air conditioner control systems can be employed also, such as the room air temperature sensor being located in the room remote from the unit or being located somewhere along the pathway of air 13 as it goes from the room to the air recirculation fan 18, if that flow pathway continues during non-cooling action.

One form of this invention comprises the preceeding described means to control the humidity and freshness of air in a dwelling without appreciably cooling the dwelling by passing a limited volume of outside fresh air across or through a refrigeration evaporator coil maintained at a desired dew point temperature range to condense undesired moisture from the fresh air where the volume of induced and chilled fresh air is insufficient to appreciably cool the dwelling.

Although I have described an evaporator coil whose temperature is controlled by cycling the compressor on and off, the temperature of the evaporator coil can also be controlled by several other conventional means including sensing the pressure drop across the compressor, by overcharging the system with refrigerant to prevent the coil from freezing up, and by providing a compressor bypass system or cut out system to be used to prevent pumping more refrigerant than needed at the time, and thus prevent over cooling the evaporator coil. Any system which prevents the coil from freezing up may be used including pumping a sufficient volume of room and/or outside fresh air through the coil to prevent coil freeze up by exceeding the compressor capacity, may be used so that the compressor can be run continuously along with continuously recirculating room air through the coil. Thus the use of a thermostat control can be eliminated. This is especially useful and is a part of this invention where the B.T.U. capacity of the unit is below the cooling needs of the room at the time it is employed to provide both cool and dehumidified air. In some cases a separate independent thermostatically controlled cooling unit can be employed which turns on or off to provide the extra B.T.U. capacity as needed for the space being controlled.

Appropriate air filters are anticipated to be employed to filter fresh and/or recirculated air. Electric resistance heaters can be employed to warm the incoming cold fresh air during cold weather, when fresh air is needed without any cooling and dehumidification, or of course whenever re-heating is desired during the fresh air dehumidification action.

It is also understood that other latent heat and sensible heat system other than the one described here, or absorbtion systems, may be used to achieve the cold chamber and cooling coil here described to accomplish the climate control system embodied in this invention.

The preferred embodiments of the invention have been illustrated and described, along with several modifications thereon but other changes and modifications can be made and some features can be used in different combinations, without departing from the invention as defined in the Claims.

I claim:

1. In a refrigeration system having a compressor, a condenser, and an evaporator connected in a series refrigerating circuit, the improvement for supplying fresh outside air to a space to gradually displace stale inside air, and to maintain the space near a desired temperature and near a desired relative humidity comprising:

a chamber containing the evaporator coil and having a fresh air inlet, a recirculating air inlet, and an air outlet;

means for substantially continuously supplying fresh outside air to the fresh air inlet whereby the fresh air may pass the evaporator coil, be cooled to condense excess moisture therefrom, and pass into the space through the air outlet; and means for intermittently supplying space air to the recirculating air inlet so that the space air may pass the evaporator, be cooled, and pass back into the space through the air outlet to maintain the space near a desired temperature.

2. The method of supplying fresh outside air to an area to gradually displace stale inside air comprising the steps of:

injecting fresh air into an insulated chamber which is maintained at a temperature by a refrigeration system to condense excess moisture from the fresh air;

passing the fresh air from the chamber into the area to maintain the relative humidity of the area near a preferred value.

3. The method of claim 2 including the further step of selectively passing the area air into the chamber and back into the area to cool that area air and maintain the temperature of the area near a preferred value.

4. The method of employing a compressor, evaporator coil, condenser coil type refrigeration unit to lower the temperature of a zone to a more preferred level while simultaneously controlling the relative humidity of that zone comprising the steps, in sequential order, of:

energizing the compressor;

allowing refrigerant to pass into the evaporator coil, to cool the coil to a temperature within a preferred moisture removing temperature range;

selectively passing air from the zone through the evaporator coil in good heat transfer relation therewith and only after the evaporator coil has reached the range to cool the air and remove undesired excess moisture therefrom;

passing fresh air from outside the zone through the evaporator coil in good heat transfer relation therewith so long as the evaporator coil temperature remains within the preferred range; and forcing the thus cooled and humidity controlled air back into the zone.

5. The method of claim 4 comprising the further step of stopping the air flow through the evaporator coil when the temperature thereof rises above a predetermined dew point temperature range.

6. In a refrigeration system having a compressor, a condenser, and an evaporator, the improvement for maintaining a space near a desired temperature and near a desired relative humidity comprising:

an insulated chamber containing the evaporator coil and having at least a recirculating air inlet and an air outlet;

means for enabling the compressor when the temperature of the evaporator coil exceeds a first predetermined temperature; and means for intermittently circulating air from the space into the air inlet through the chamber and back into the space by way of the air outlet when the space temperature exceeds a second predetermined temperature, the first predetermined temperature being substantially less than the second predetermined temperature to assure that excess moisture is removed from the circulated space air.

7. The improvement of claim 6 further comprising means for supplying fresh outside air to the chamber so long as the temperature of the evaporator coil remains below the first predetermined temperature whereby the fresh air may pass the evaporator coil, be cooled to condense excess moisture therefrom, and pass into the space through the air outlet.

8. The improvement of claim 7 further comprising selector switch means for selectively enabling the means for supplying fresh outside air and for selectively enabling the means for circulating space air to obtain a desired combination of cooling and ventilating

9. The process of limiting the moisture content in a dwelling comprising the steps of:

controlling the dew point temperature range of a refrigeration evaporator coil to substantially continuously maintain that temperature below a selected value; and passing a limited volume of outside air substantially continuously through the coil so long as the evaporator coil temperature remains below the selected value and into the dwelling to control the relative humidity in the dwelling by the influx of air of the thus limited moisture content.

10. The process of claim 9 comprising the further step of controlling the temperature of air within the dwelling by intermittently recirculating a controlled volume of dwelling air through the evaporator coil and back into the dwelling.

11. The process of claim 9 wherein the volume of outside air is insufficient to appreciably reduce the air temperature within the dwelling.

* * * * *